US006217697B1

(12) United States Patent
Winter et al.

(10) Patent No.: US 6,217,697 B1
(45) Date of Patent: Apr. 17, 2001

(54) METHOD FOR PRODUCING AND COATING MELT PORTIONS AS WELL AS SYSTEM AND APPARATUS

(75) Inventors: Jürgen Winter, Herrenberg; Matthias Kleinhans, Waiblingen; Warnfried Baumann, Beinstein, all of (DE)

(73) Assignee: Santrade Ltd., Luzern (CH)

( * ) Notice: Subject to any disclaimer, the term of this patent is extended or adjusted under 35 U.S.C. 154(b) by 0 days.

(21) Appl. No.: 09/309,265

(22) Filed: May 11, 1999

Related U.S. Application Data

(62) Division of application No. 08/910,989, filed on Aug. 14, 1997, now Pat. No. 5,942,082.

(30) Foreign Application Priority Data

Aug. 15, 1996 (DE) ..... 196 32 787

(51) Int. Cl.[7] ..... B32B 31/00

(52) U.S. Cl. ..... 156/270; 156/289; 156/291; 156/301; 53/239; 53/287; 53/401; 53/416; 53/454; 53/467; 53/473; 53/477; 53/560; 53/546; 53/547; 53/548

(58) Field of Search ..... 53/545, 547, 546, 53/548, 287, 401, 410, 440, 453, 454, 467, 473, 477, 523, 527, 416, 559, 560, 239; 156/269, 270, 271, 289, 291, 301

(56) References Cited

U.S. PATENT DOCUMENTS

| | | | | |
|---|---|---|---|---|
| Re. 36,177 | | 4/1999 | Rouyer et al. | 53/428 |
| 2,633,684 | * | 4/1953 | Rohdin | 53/511 |
| 3,383,263 | | 5/1968 | Storti | 156/235 |
| 3,481,283 | * | 12/1969 | Vogt | 53/122 |
| 3,498,019 | | 3/1970 | Rait | 53/450 |
| 3,851,438 | | 12/1974 | Brisman | 53/431 |
| 4,004,870 | | 1/1977 | Güttinger et al. | 425/24 |
| 4,027,047 | | 5/1977 | Harima | 426/383 |
| 4,334,468 | | 6/1982 | Güttinger et al. | 100/311 |
| 5,257,491 | | 11/1993 | Rouyer et al. | 53/428 |
| 5,569,348 | | 10/1996 | Hefele | 156/239 |
| 5,622,263 | * | 4/1997 | Greenland | 206/561 |
| 5,715,654 | * | 2/1998 | Taylor et al. | 53/440 |
| 5,806,285 | * | 9/1998 | Rizzieri | 53/453 |

FOREIGN PATENT DOCUMENTS

| | | |
|---|---|---|
| 281 307 | 2/1952 | (CH) . |
| 41 26 854 | 12/1992 | (DE) . |
| 42 05 919 | 9/1993 | (DE) . |
| 93 18554 | 3/1994 | (DE) . |
| 0 083 323 | 7/1983 | (EP) . |
| 1 137 649 | 12/1968 | (GB) . |

* cited by examiner

*Primary Examiner*—Linda Gray
(74) *Attorney, Agent, or Firm*—Burns, Doane, Swecker & Mathis, L.L.P.

(57) ABSTRACT

A method for producing and coating melt portions includes two sheet strips, which form coating material layers, being continually fed. The melt portions embedded between the sheet strips are cooled and calibrated according to their thickness. The sheet strips are longitudinally and transversely separated in the region of their connection points such that the melt portions become isolated and the sheet strips are connected to each other such that each melt portion is embraced tightly.

9 Claims, 4 Drawing Sheets

METHOD FOR PRODUCING AND COATING MELT PORTIONS AS WELL AS SYSTEM AND APPARATUS

This application is a divisional of application Ser. No. 08/910,989, filed Aug. 14, 1997, U.S. Pat. No. 5,942,082.

TECHNICAL FIELD

The present invention relates to a method for producing and coating melt portions, in particular melt adhesive portions, in which the melt is deposited in portions onto an endlessly circulating, horizontal conveyor belt. A first coating material layer is fed onto the surface of the upper end of the belt of the conveyor belt and a second coating material layer partly is applied onto the melt portions deposited on the first coating material layer and partly covering the surface of the melt portions. The present invention is also directed to a system and a device for the application of a melt in defined melt portions for the system.

BACKGROUND OF THE INVENTION

A system for the coating of melt adhesive portions is known from the German patent specification DE 93 18 554 U1. The system disclosed in this specification exhibits an endless circulating horizontal conveyor belt that is coated with a powdery coating material at the feed side. Then, a melt adhesive is applied in defined melt adhesive portions onto the moving conveyor belt. In an additional work station, a powdery coating material layer is applied onto the surface of the melt adhesive portions from above. Then, the melt adhesive portions that are coated on both sides with the coating material pass through a heating station that liquefies the powder of the coating material and that causes an even coating of the melt adhesive portion. A cooling area is attached to the heating station, in which the coated melt adhesive portions are cooled down. After having passed the cooling area, the melt adhesive portions are removed from the conveyor belt and packed in larger units.

SUMMARY OF THE INVENTION

The object of the present invention is to provide a method as well as a system of the above-mentioned kind that guarantees a faster and enhanced production and coating of melt adhesive portions.

This object is accomplished in that two sheet strips are continuously fed as coating material layers, the material properties of which are adjusted to the melt regarding chemical tolerance, and that the thickness of the melt portions imbedded between the sheet strips is calibrated in thickness, the melt portions are cooled, the sheet strips are connected to each other by closely encompassing each melt portion, and the sheet strips are cut lengthwise and crosswise to the conveying direction of the melt portions such that the melt portions become isolated. A smooth coating of the melt portion that can be easily handled is already achieved by providing the sheet strips without providing the heating station, as is provided in the related prior art, with the result that the expenditure of energy and thus also costs for the method of the present invention are reduced. The calibration of the thickness of the melt portions results in a more even and more defined cooling so that—compared with the related prior art—an improved cooling behavior is achieved. The sheet strips can be connected in the transition regions between the adjacent melt portions either before or after separating the sheet strips and the resulting isolation of the melt portions. The method according to the invention can be used for all molten masses, but it is particularly well suited for melt adhesives, the strongly adhesive surface of which has to be coated for easier further handling. Due to the chemical tolerance of the sheet strips with the melt, the melt is not impaired by the sheet material.

In one embodiment of the invention, the melt is prepared to have a specified viscosity at a specified temperature and is then applied step by step on the conveyor belt in equal portions, thus achieving even and consistent portioning. In addition, by preparing the melt, it is well adapted to the following cooling of the melt portions on the conveyor belt.

In a further embodiment of the invention, the melt portions are inserted into appropriate matrix spaces of a grid mask that is assigned to the conveyor belt and which travels with the latter and is disposed underneath the lower sheet strip. In this instance, the volume of the melt portion is adjusted to the free volume of each matrix space such that the molten mass overflows over the rims of each matrix space. The thickness of the calibrated melt portions is also greater than the height of the grid mask. By overflowing over the rims of each matrix space, the molten mass itself forms the connection between the two sheet strips forming the top and the bottom covering layers, because it adheres to the two sheet strips. This embodiment is particularly advantageous for melt adhesives having a strong adhesive surface. Contrary to other embodiments of the present invention, welding or gluing the sheet strips may be avoided in this embodiment. The molten mass overflowing over the rims has only a minor thickness so that the two sheet strips are only connected along the rims in an extremely small distance. Due to the grid mask, it is possible to achieve an individual shaping of the melt portions according to the form of the matrix spaces.

In another embodiment of the invention, before feeding of the sheet strips to the conveyor belt, a separating layer is inserted or provided between the underside of the first sheet strip resting on the conveyor belt or the grid mask and the surface of the conveyor belt or the grid mask. This prevents the sheet strip from adhering to the surface of the conveyor belt or the grid mask and causing damages when the melt portions are loosened.

In another embodiment of the invention, an additional separating layer is inserted or provided between the surface of the second sheet strip that touches an upper conveyor belt during calibration and cooling, and the belt surface of the conveyor belt. This separating layer also serves to facilitate an easy detachment of the sheet strip from the surface of the top belt after passing the cooling region.

In another embodiment of the invention, a water spray forms each of the separating layers. In addition to serving as a separator, water also has an additional cooling function in that the sheet strips touching the melt portions are cooled by the water layer between the respective belt surface and the assigned sheet strip.

For the system, the object according to the invention is accomplished in that the conveyor belt is part of a twin belt cooler used for cooling and that a storage roll equipped with a removable sheet strip is assigned to the conveyor belt and to the upper endless circulating belt of the twin belt cooler such that the sheet strips travel with the two belts at the end of the belts that face each other. A significant advantage using a twin belt cooler is that a calibration of the melt portions is achieved in its thickness, which makes a particularly even and defined cooling of the melt portions possible.

In another embodiment of the invention, the melt temperature of the sheet strip is lower than the processing temperature of the melt. As soon as the melt portions including the coating by means of the sheets are fed into a melt bath, the sheets melt without any residues that could impair the melt bath. Thus, there is no packaging refuse.

In another embodiment of the invention, a longitudinal cutting assembly and a transverse cutting assembly are assigned to the conveying path of the melt portions in the conveying direction behind the twin belt cooler. Thus, it is possible to separate the different rows of melt portions by isolating the respective melt portions.

In another embodiment of the invention, a matrix-shaped grid mask that can travel with the conveyor belt is assigned to the conveyor belt, which grid mask covers at least a major part of the belt surface and at least the length of the conveying end of the belt. The individual matrix spaces of the grid mask border the melt portions on all sides, wherein the melt portions are given an individual shape. The grid mask can either be carried along as a separate net strip with the conveyor belt or it can be firmly connected with the surface of the conveyor belt, thus also resulting in the conveyor belt being carried along.

In another embodiment of the invention, the height of the grid mask is less than the height of the cooling gap defined by the twin belt cooler. This embodiment guarantees that part of the molten mass of each melt portion flows over the edges of each grid space within the twin belt cooler, thus causing a connection between the upper and the lower sheet strips by means of the overflowed molten mass, in particular in case of a melt adhesive, without the necessity of additional welding or connecting processes.

In another embodiment of the invention, a spray damper for applying a separating layer is assigned to both sheet strips such that the separating layer can be sprayed onto each belt surface facing each sheet strip and/or onto each corresponding belt surface. Thus, the sheet strips can be easily detached at the exit of the twin belt cooler and at the carrying side of the conveyor belt, respectively.

BRIEF DESCRIPTION OF THE FIGURES

Additional advantages and features of the invention ensue from the claims and from the following disclosure of preferred exemplary embodiments of the invention, which are depicted in the drawings as follows:

DETAILED DESCRIPTION OF THE PREFERRED EMBODIMENTS

Figure 2:
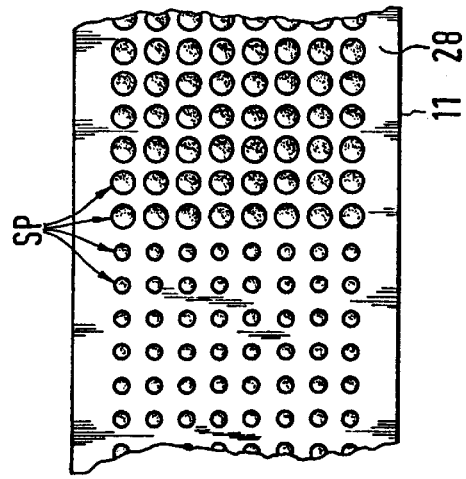
FIG. 2 is a top view of a conveyor belt at the level of an inlet region of the twin belt cooler according to FIG. 1.
Figure 1:
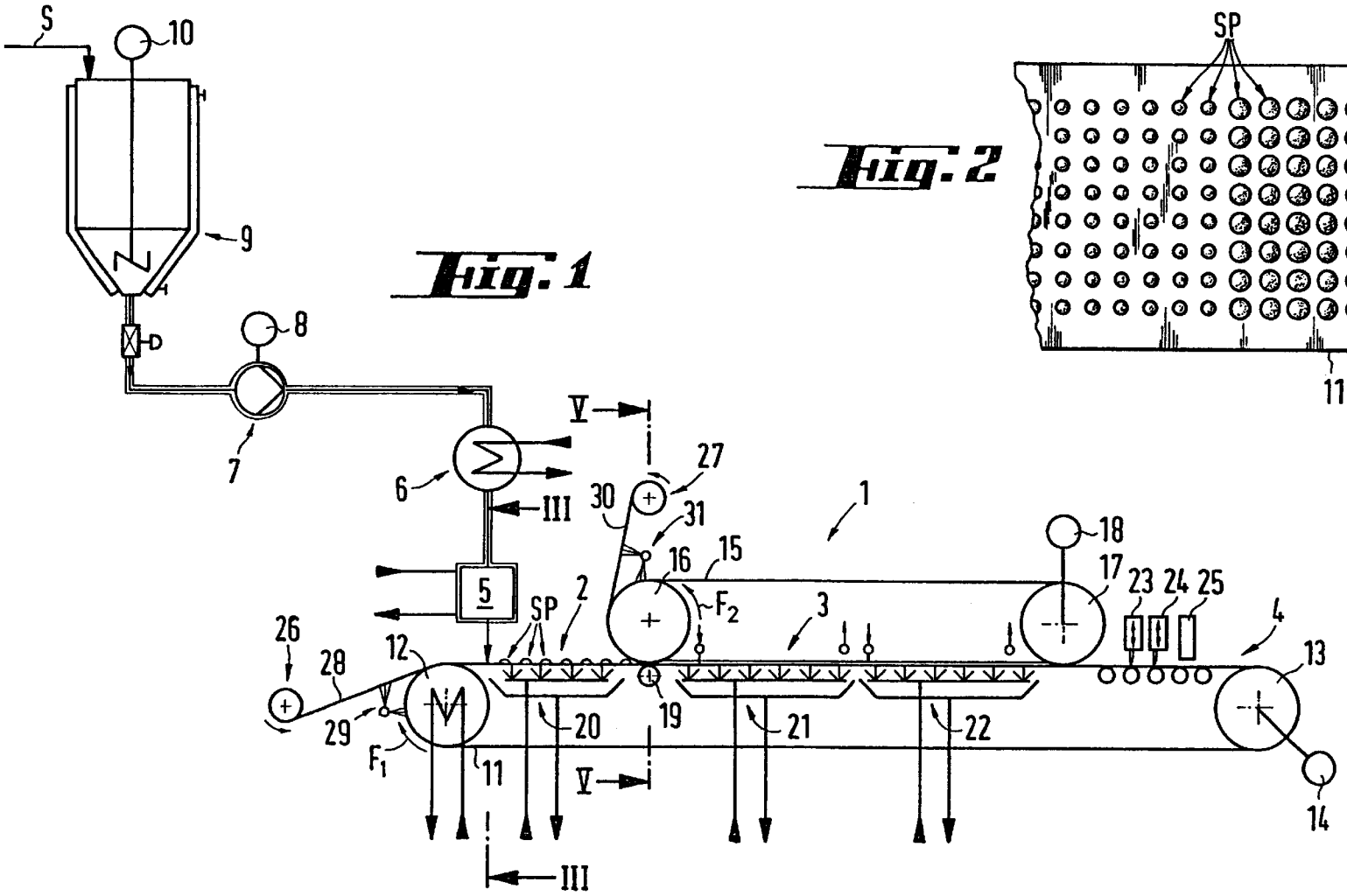
FIG. 1 schematically illustrates a first specific embodiment of a system according to the invention for the production and coating of melt portions having a twin belt cooler.
Figure 3:
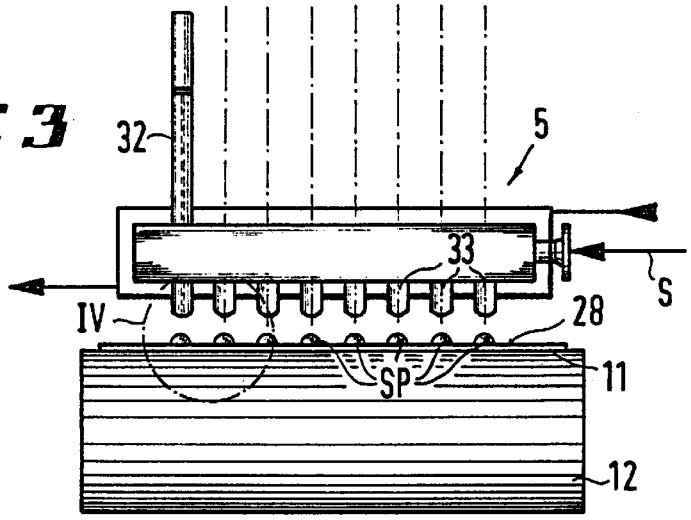
FIG. 3 schematically illustrates an application device for melt portions onto the conveyor belt for the system according to FIG. 1 in the direction of the arrows III—III in FIG. 1.
Figure 4:
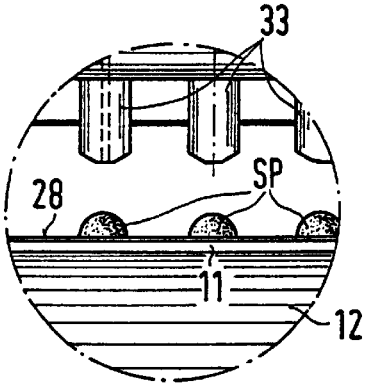
Fig.4 is an enlarged partial section IV from FIG. 3.

A system for fabricating a molten mass in defined melt portions of equal size and for coating these melt portions involves a twin belt cooler 1 as the central part of the system. An application region 2 that is disclosed in detail hereinafter is situated before the actual cooling region 3 of twin belt cooler 1. A delivery region 4 is situated in conveying direction $F_1$, $F_2$ behind twin belt cooler 1 at cooling region 3. Twin belt cooler 1 is formed by a lower conveyor belt 11 and an upper conveyor belt 15. Lower conveyor belt 11 circulates endlessly around a heated feed roller 12 and a delivery roller 13 that is driven by a drive motor 14, wherein feed roller 12 is disposed at a distance before upper conveyor belt 15 and delivery roller 13 at a distance behind conveyor belt 15. The upper end or surface of belt 11 is disposed horizontally and forms a lower end or surface of the belt in cooling region 3 of twin belt cooler 1. Upper belt 15 circulates endlessly around a feeding roller 16 in conveying direction $F_2$ as well as around a delivery roller 17 that is driven by drive motor 18, wherein a lower end or surface of belt 15 forms the upper end or surface of the belt cooling region 3 of twin belt cooler 1, limiting it at the top. In cooling region 3, the ends or surfaces of the belts of conveyor belt 11 and of conveyor belt 15 facing each other run parallel to each other. Three cooling regions 20, 21, 22 are assigned to conveyor belt 11, the first of the cooling regions is disposed in application region 2 in front of cooling region 3. The two other cooling regions 21 and 22 adjoin in cooling region 3, e.g., in the cooling gap between conveyor belt 11 and belt 15 in the conveying direction.

In application region 2, a molten mass in form of a melt adhesive S is deposited on conveyor belt 11 in specified viscosity in defined melt adhesive portions SP each in rows of eight in equal distances by means of a feeder head 5 used as a portioning device (FIGS. 1 through 4). To be able to apply molten mass S with a specified viscosity by means of feeder head 5 onto conveyor belt 11, a fabrication device in the form of a heat transfer medium 6 is disposed in front of feeder head 5, wherein preheated molten mass S passes through said heat transfer medium 6. Molten mass S is fed into heat transfer medium 6 from a reservoir 9 equipped with a rabble 10 by means of a pump 7 that is driven by drive motor 8. In the exemplary embodiment shown, the portioning device in the form of feeder head 5 disposes a horizontal inlet for the molten mass S, wherein eight blades 32 are assigned to said inlet, which press appropriately defined melt portions through eight casting nozzles 33 onto conveyor belt 11 below. Melt adhesive portions SP are applied onto conveyor belt 11 in a hemispherical shape (see FIGS. 3 and 4) and in pasteurized condition. The rows of eight melt adhesive portions SP are arranged next to each other and cover most of the extend of conveyor belt 11, which is designed as a steel belt.

To prevent the melt adhesive portions SP from adhering to conveyor belt 11, which is preferably a steel belt, a polyethylene sheet strip 28 is fed into conveyor belt 11 in the region of feed roller 12 before applying melt adhesive portions SP, which sheet strip serves as a base for melt adhesive portion SP and which lies flat on the surface of conveyor belt 11. The width of sheet strip 28 approximately coincides with conveyor belt 11 and has at least the total width of the cross row of the eight melt portions SP. Sheet strip 28 is continuously pulled off from a storage roll 26, on which sheet strip 28 is wound up, which storage roll 26 is seated to be pivotable by means of bearings.

In an exemplary embodiment according to the invention, molten mass S has a melt point of approximately 180° C.

Since sheet strip 28 is the base for all melt adhesive portions SP that are deposited on conveyor belt 11 in application region 2, sheet strip 28 also represents the underside of a coating of melt adhesive portions SP. Water spray damper 29 is assigned to sheet strip 28 and feed roll 12 between the belt surface of conveyor belt 11 and sheet strip 28 as a separator, which water spray damper 29 moistens both the belt surface of belt 11 and the underside of sheet strip 28 with a mist. Besides its effect as a separator, the water spray also has the advantage of a cooling effect, wherein the water film between sheet strip 28 and the belt surface prevents the molten mass applied by feeder head 5 (the temperature of which during application is higher than the melt point of sheet strip 28) from causing the sheet strip 28 to melt. It is advantageous that the plastic material of sheet strip 28 be adjusted with regard to its melting points and the processing temperature of molten mass S so that the melting of sheet strip 28 due to the applied molten mass is prevented in any case. In addition, the plastic material of sheet strip 28 is chosen such that it cannot chemically react with molten mass S, which means that it does not impair the properties of molten mass S. Since sheet strip 28 does adhere to melt adhesive portions SP, but not to the belt surface of conveyor belt 11, sheet strip 28 including melt adhesive portions SP can be easily detached from the belt surface on the delivery side, as disclosed in detail hereafter.

A plastic sheet strip 30, preferably also made of polyethylene, is analogously fed into the belt surface of upper belt 15 of twin belt cooler 1. Plastic sheet strip 30 is wound up on storage roll 27, which is seated above feed roll 16 of belt 15 in a frame that is not shown to be seated such that it is pivotable. A separating layer in the form of a water spray is also applied by means of a water spray damper 31 between sheet strip 30 and the belt surface of belt 15. Water spray damper 31 exhibits a spray stream directed to the belt surface of belt 15 and another spray stream directed to the assigned surface of sheet strip 30. Other means of separating layers of course can be used instead of water spray dampers.

Figure 5:
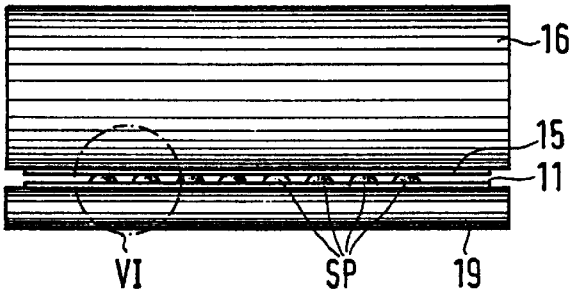
FIG. 5 is a section of the system according to FIG. 1 at the level of section line V—V in FIG. 1.
Figure 6:
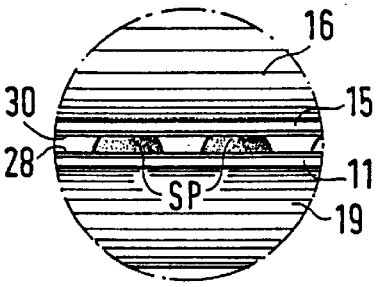
FIG. 6 is an enlarged partial section VI from FIG. 5.
Figure 8:
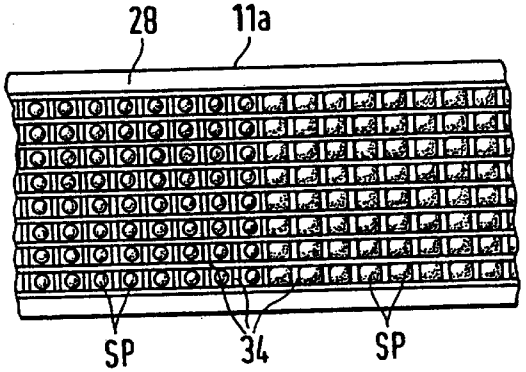
FIG. 8 is a top view of the conveyor belt of the system according to FIG. 7 at the level of an inlet region of a twin belt cooler of the system according to FIG. 7.

The cooling gap of cooling region 3 of twin belt cooler 1 between the ends or surfaces of belt 15 and facing conveyor belt 11 is defined by a calibration roll 19 situated at the level of feed roll 16, which calibration roll can be adjusted in any known manner. Due to the height of the cooling gap of cooling region 3 defined by the distance of calibration roll 19 to feed roll 16, melt adhesive portions SP are flattened while entering the cooling gap, according to FIG. 2, giving them a disc-shape with a larger diameter. The equal thickness of melt adhesive portions SP due to the calibration in the cooling gap, guarantees that the melt adhesive portions cool off equally by passing through cooling regions 21 and 22 within twin belt cooler 1. The shaping of melt adhesive portions SP by entering into the cooling gap of cooling region 3 at the level of calibration roll 19 is well recognizable by means of FIGS. 5 and 6. Since sheet strip 30 fits closely and evenly to the belt surface of belt 15 analogously to sheet strip 28, sheet strip 30 simultaneously forms the covering coat layer for melt adhesive portions SP conveyed through the cooling gap in cooling region 3. Thus, melt adhesive portions SP are lead through between two layers of sheet strips 28, 30 through cooling region 3. Two sheet strips 28 and 30 each adhere in the region of the surface and the underside of each melt adhesive portion SP onto the respective melt adhesive portion SP.

In order to achieve a detachment of the individual melt adhesive portions SP after passing through cooling region 3 and in order to achieve a complete coating by means of the sheet strip sections assigned to each melt adhesive portion SP, a longitudinal cutting assembly 23 and a transverse cutting assembly 24 are assigned to conveyor belt 11 in delivery region 4. Longitudinal cutting assembly 23 and transverse cutting assembly 24 serve as to separate longitudinal and transverse rows of melt adhesive portions SP, in that the two sheet strips are cut between the respective longitudinal and transverse rows. After passing through longitudinal and transverse cutting assemblies 23, 24, a double-sided sheet cut for each melt adhesive portion SP results, wherein the upper cut part is formed by an appropriate cut part of sheet strip 30 and the lower cut part is formed by an appropriate cut part of sheet strip 28. If the plastic material of the sheet strip already exhibits sufficient adhesive properties, it suffices to press the edges of the sheet cuts of each melt adhesive portion SP together, wherein the cut parts of each sheet cut facing each other connect to each other and embrace each melt adhesive portion SP on all sides. In addition, a welding device 25 is provided for this exemplary embodiment to achieve a secure connection of the upper and lower cut parts of the sheet cuts of the melt adhesive portions SP, which welding device welds the edges of the sheet cuts on all sides around the respective melt adhesive portion SP. In the disclosed exemplary embodiment, this welding device 25 is disposed behind the cutting assemblies in the conveying direction. The welding device can also be disposed in front of the cutting assemblies or it can be combined with the cutting assemblies by providing a resistance wire configuration, in that the resistance wire configuration undertakes both the welding and the connecting.

At the level of delivery roll 13, the isolated and packed, e.g., coated melt adhesive portions SP, can be detached from the belt surface of conveyor belt 11. Then they are assorted into appropriate units of quantity and packed. According to their future use, the melt adhesive portions can be directly transferred into an appropriate melt bath, wherein the sheet cuts melt on without hazardous residues, because the melt point of the melt adhesive portion is higher than the melt point of the sheet cuts.

Figure 7:
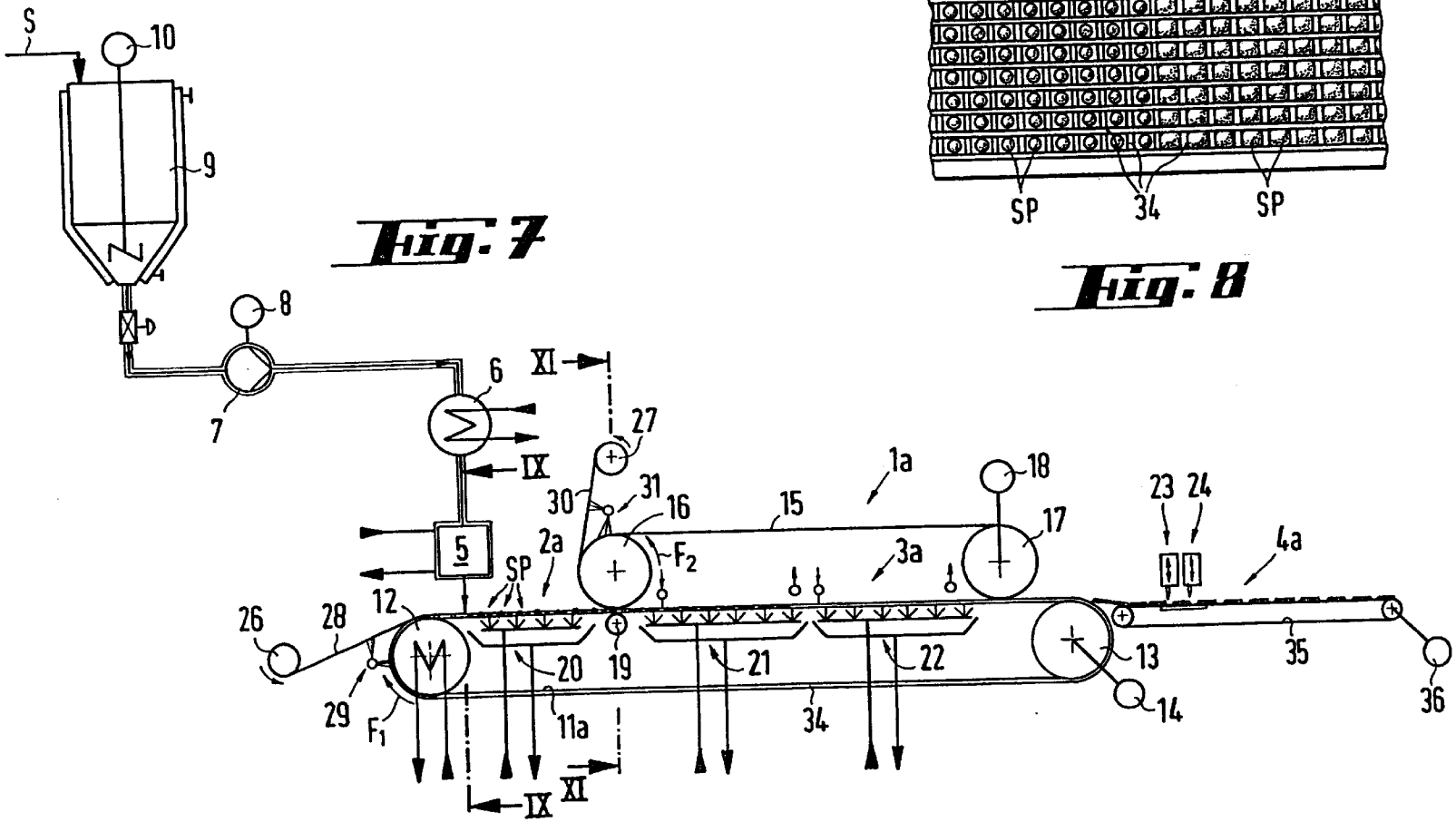
FIG. 7 illustrates another specific embodiment of a system according to the invention for the production and coating of melt portions.
Figure 9:
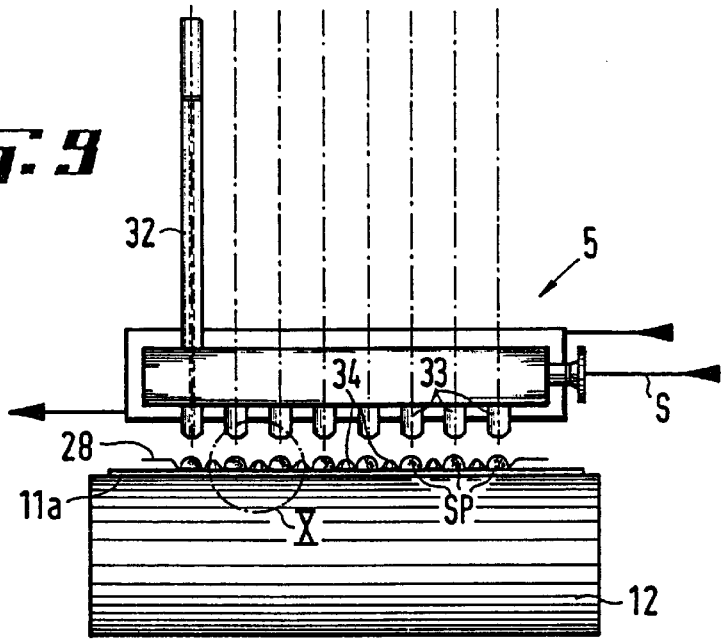
FIG. 9 is a view of an application device of the system according to FIG. 7 in the direction of arrows IX—IX of FIG. 7.

The system according to FIGS. 7 through 12 corresponds in its essential functional units to the system according to FIGS. 1 through 6 disclosed in detail above, so that regarding identical functional units, reference is made to the disclosure of the exemplary embodiment according to FIGS. 1 through 6. Identical components and modular units of the system according to FIG. 7, are labeled with the same reference marks as for the system according to FIG. 1. The essential differences of the specific embodiment according to the invention according to FIGS. 7 through 12 are defined by a different shaping of melt adhesive portions SP, wherein the outwardly facing belt surface of the conveyor belt 11*a* exhibits a matrix-shaped grid mask 34. In the disclosed exemplary embodiment, grid mask 34 according to FIGS. 7 through 12 is connected with the belt surface of conveyor belt 11*a* on all sides and exhibits a grid pattern on all sides that consists of stays that are disposed longitudinally and transversely to conveying direction $F_1$, $F_2$. The longitudinal and transverse stays each form transverse rows of eight grid spaces—which are also called matrix spaces—arranged next to each other, into which one melt adhesive portion SP each can be applied by means of portioning device 5.

Figure 10:
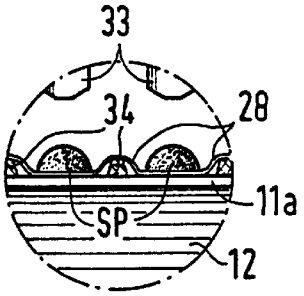
FIG. 10 is an enlarged partial section X of the drawing from FIG. 9.
Figure 11:
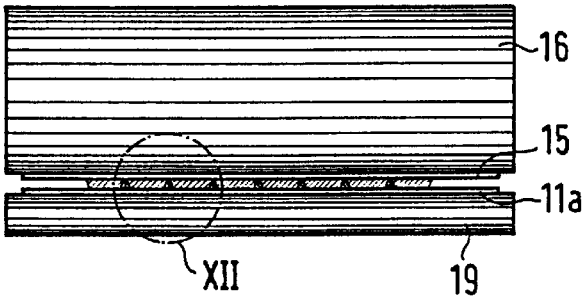
FIG. 11 is a section through the system according to FIG. 7 at the level of an inlet region of a twin belt cooler along the section line XI—XI in FIG. 7.
Figure 12:
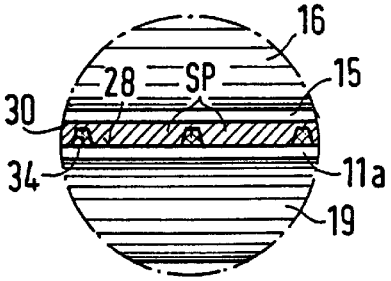
FIG. 12 is an enlarged partial section XII of the inlet region from FIG. 11.

Sheet strip 28 is fed to conveyor belt 11*a* such that it rests on grid mask 34. By applying melt adhesive portions SP into the grid spaces, sheet strip 28 is pressed down onto the belt surface of conveyor belt 11*a* in these regions. At the same time, it covers, however, all sides of grid mask 34 (FIG. 10). The height of grid mask 34 is slightly lower than the height of the cooling gap within cooling region 3*a* of twin belt cooler 1*a,* which cooling gap is defined by the calibration roll 19. In application region 2*a,* melt adhesive portions SP are applied into the grid spaces of grid mask 34 in such volumes that melt adhesive portions SP protrude the stays of grid mask 34 (see FIGS. 9 and 10). The molten mass and the volume of each melt adhesive portion SP is adjusted to the respective grid space of grid mask 34 in a way that melt adhesive portions SP in the cooling gap (see FIGS. 11 and 12) completely fill out the respective grid space in grid mask 34 and that a certain portion of the molten mass of each melt adhesive portion SP extends over the edges of each grid space, defined by the stays, on all sides. Since upper sheet strip 30 travels into cooling region 3*a* together with belt 15 when entering the cooling gap, as in the exemplary embodiment according to FIGS. 1 through 6, upper sheet strip 30 forms the upper coating layer for melt adhesive portions SP. Due to the overflow of the molten mass of melt adhesive portions SP over the stays of grid mask 34 (FIG. 12), at the level of the longitudinal and transverse stays of grid mask 34, a patent, relatively thin melt film forms which—in the transition regions between individual melt adhesive portions SP—creates a connection between opposite sheet strips 28 and 30, because, in the region of this grid-shaped melt film, sheet strips 28 and 30 only adhere to the melt film along a small distance.

After cooling off melt adhesive portions SP in cooling region 3*a,* the continuous strip of melt adhesive portions SP and sheet strip 28, 30 covering melt adhesive portions SP can be detached from conveyor belt 11*a* and from grid mask 34 and can be transferred to a separate conveyor belt 35 in a delivery region 4*a*. Conveyor belt 35 also provides a circulating endless belt moving around a feed roll and a delivery roll, wherein the delivery roll is driven by a drive motor 36. Melt adhesive portion strip including adhering sheet strips 28 and 30 is now separated into the individual melt adhesive portions by means of longitudinal cutting assembly 23 and transverse cutting assembly 24, wherein the separation of longitudinal cutting assembly 23 and transverse cutting assembly 24 is each executed at the level of the grid-shaped melt film between melt adhesive portions SP. Because the sheet cuts formed in this manner are already connected to each other by the melt film along the edges of the separated melt adhesive portions on all sides and because the narrow open edges of the melt film do not have to be sealed additionally by appropriate sheet cuts, directly after separation of longitudinal cutting assembly 23 and transverse cutting assembly 24, the coated melt adhesive portion is prepared, without the necessity of additional melt processes of the sheet cuts.

We claim:

1. A method for producing and coating melt portions comprising:

feeding a first coating material layer onto an upwardly facing surface of an endlessly circulating, horizontal conveyor belt;

depositing a melt in portions onto the first coating material;

applying a second coating material layer onto the melt portions deposited on the first coating material layer and covering a top surface of the melt portions, wherein the first and second coating material layers include lower and upper sheet strips, respectively;

calibrating the thickness of the melt portions imbedded between the sheet strips;

cooling the melt portions;

connecting the sheet strips to each other by closely encompassing each melt portion; and cutting the sheet strips longitudinally and transversely to the conveying direction of the melt portions in such a way that the melt portions become isolated.

2. The method according to claim 1, wherein said depositing step includes conditioning the molten mass for a specified viscosity to a specified temperature and then depositing the molten mass onto the conveyor belt in equal portions.

3. The method according to claim 1, wherein said depositing step includes inserting the melt portions into appropriate matrix spaces of a grid mask that is assigned to the conveyor belt, traveling with the conveyor belt, and disposed underneath the lower sheet strip and also adjusting the volume of the melt portion to the free volume of each matrix space such that the molten mass overflows over the rims of each matrix space and the thickness of the calibrated melt portions is greater than the height of the grid mask.

4. The method according to claim 1, further comprising, prior to the feeding step, inserting a separating layer onto the upwardly facing surface.

5. The method according to claim 4, further comprising inserting an additional separating layer between a surface of the upper conveyor belt and a surface of the second sheet strip that faces such belt surface during calibration and cooling.

6. The method according to claim 4, wherein said inserting step includes providing a water membrane as the separating layer.

7. The method according to claim 5, wherein said inserting step includes providing a water membrane as the additional separating layer.

8. The method according to claim 1, wherein said feeding and applying steps include continuously feeding the lower and upper sheet strips.

9. The method of according to claim 1, wherein said depositing step includes depositing melt adhesive portions.

* * * * *